US008878764B2

(12) United States Patent
Hsu et al.

(10) Patent No.: US 8,878,764 B2
(45) Date of Patent: Nov. 4, 2014

(54) DRIVING METHOD AND RELATED DEVICE FOR REDUCING POWER CONSUMPTION OF LCD BY COMPARING RECEIVED DATA

(75) Inventors: Chin-Hung Hsu, Tao-Yuan Hsien (TW); Yueh-Hsiu Liu, Hsinchu (TW); Chih-Chiang Chuang, Hsinchu (TW); Li-Jun Chen, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 951 days.

(21) Appl. No.: 12/211,102

(22) Filed: Sep. 15, 2008

(65) Prior Publication Data

US 2009/0309860 A1 Dec. 17, 2009

(30) Foreign Application Priority Data

Jun. 11, 2008 (TW) ..... 97121730 A

(51) Int. Cl.
*G09G 3/36* (2006.01)

(52) U.S. Cl.
CPC ..... *G09G 3/3685* (2013.01); *G09G 2370/08* (2013.01); *G09G 2330/021* (2013.01); *G09G 2320/103* (2013.01); *G09G 2330/06* (2013.01)
USPC ..... 345/99

(58) Field of Classification Search
CPC ..... G09G 3/3685
USPC ..... 345/98–100
See application file for complete search history.

(56) References Cited

U.S. PATENT DOCUMENTS

| | | | | |
|---|---|---|---|---|
| 6,356,260 | B1 * | 3/2002 | Montalbo | 345/100 |
| 6,683,596 | B2 * | 1/2004 | Ozawa | 345/100 |
| 7,542,022 | B2 * | 6/2009 | Park | 345/98 |
| 2002/0000969 | A1 * | 1/2002 | Ozawa | 345/100 |
| 2002/0044118 | A1 * | 4/2002 | Sekido et al. | 345/87 |
| 2005/0264546 | A1 * | 12/2005 | Chou et al. | 345/204 |
| 2006/0071897 | A1 * | 4/2006 | Moon | 345/98 |
| 2007/0222737 | A1 * | 9/2007 | Kimura | 345/100 |
| 2008/0170028 | A1 * | 7/2008 | Yoshida | 345/100 |

FOREIGN PATENT DOCUMENTS

| | | | | |
|---|---|---|---|---|
| CN | 1627354 | A | 6/2005 | |
| CN | 1856818 | A | 11/2006 | |
| CN | 1941054 | A | 4/2007 | |
| CN | 1983355 | A | 6/2007 | |
| CN | 101004499 | A | 7/2007 | |
| EP | 1662468 | A2 * | 5/2006 | G09G 3/32 |
| TW | 475079 | | 2/2002 | |
| TW | I230916 | | 4/2005 | |
| TW | I252454 | | 4/2006 | |

* cited by examiner

*Primary Examiner* — Adam J Snyder
(74) *Attorney, Agent, or Firm* — Winston Hsu; Scott Margo

(57) ABSTRACT

A driving method is provided for reducing power consumption of a liquid crystal display. The driving method includes steps of sequentially receiving first data and second data, determining whether the second data is the same as the first data, and controlling a data-line driving circuit not to read in driving data corresponding to the second data when the second data is the same as the first data.

26 Claims, 11 Drawing Sheets

DRIVING METHOD AND RELATED DEVICE FOR REDUCING POWER CONSUMPTION OF LCD BY COMPARING RECEIVED DATA

BACKGROUND OF THE INVENTION

1. Field of the Invention

The present invention relates to a driving method and related device of an LCD, and more particularly, to a driving method and related device for reducing power consumption and electromagnetic interference of the LCD.

2. Description of the Prior Art

Featuring low radiation, thin appearance and low power consumption, liquid crystal display (LCD) devices have gradually replaced traditional cathode ray tube (CRT) displays and are widely used in information products such as notebook computers, personal digital assistants (PDA), flat panel televisions and mobile phones.

Generally, a driving system of the LCD device is formed by a timing controller, a data-line driving circuit and a scan-line driving circuit. The timing controller is utilized for generating driving data of the LCD device according to image data being received, as well as timing signals and control signals required for operating the LCD device. The data-line driving circuit and the scan-line driving circuit are utilized for performing logic operations on the driving data, the timing signals and the control signals to generate driving signals of data-lines and scan-lines, respectively.

The timing signals generated by the timing controller may include a horizontal clock signal (CPH) and a vertical clock signal (CPV), for example, while the control signals may include a horizontal start signal (STH), a vertical start signal (STV), a data load signal (LD), a polarity control signal (POL) and an output enable signal (OE), all of which are well-known by those skilled in the art and not narrated herein. In addition, the data-line driving circuit and the scan-line driving circuit may further include multiple source drivers and multiple gate drivers. Each of the source drivers (or the gate drivers) is utilized for driving multiple data-lines (or multiple scan-lines), and required quantities of the source drivers and the gate drivers are determined by resolution of the LCD device.

In the prior art, the data-line driving circuit usually takes the scan-line as a basic unit to output the data-line driving signals of a same scan-line sequentially line-by-line, so as to drive the LCD panel for displaying an image. In this case, the data-line driving circuit has to read in the driving data outputted by the timing controller successively to generate the data-line driving signals according to the control signals and the clock signals.

Please refer to FIG. 1. FIG. 1 shows a timing diagram of a conventional LCD device, in which T_DATA stands for the driving data outputted by the timing controller, CPH stands for the horizontal clock signal, STH stands for the horizontal start signal, LD stands for the data load signal, POL stands for the polarity control signal, and LINE_n stands for the data-line driving signal corresponding to one data-line in the LCD device. The horizontal clock signal CPH provides a reference clock for operating the data-line driving circuit; the horizontal start signal STH triggers the data-line driving circuit to receive the driving data outputted by the timing controller; the data load signal LD controls output operation of the data-line driving circuit; and the polarity control signal POL controls polarity of the data-line driving signal outputted by the data-line driving circuit. In addition, for the purpose of convenience, the driving data T_DATA outputted by the timing controller is shown by blocks. Each block represents driving data corresponding to a same scan-line, and blank space represents a blanking signal for separating the adjacent driving data.

From the standpoint of the $(N-1)^{th}$ scan-line, the horizontal start signal STH corresponding to the $(N-1)^{th}$ scan-line is firstly generated to control the data-line driving circuit to receive a corresponding driving data block. Then, the data-line driving circuit is controlled to output a data-line driving signal and convert the polarity of the data-line driving signal by the data load signal LD and the polarity control signal POL corresponding to the $(N-1)^{th}$ scan-line, respectively. Similarly, such operation is repeated for the $N^{th}$ and the $(N+1)^{th}$ scan-line as well.

In the prior art, when two image data successively received by the timing controller, such as image data corresponding to the $(N-1)^{th}$ and the $N^{th}$ scan-line, are the same, the driving data, the clock signal and the control signal still have to be generated repeatedly for driving the $(N-1)^{th}$ and the $N^{th}$ scan-line according to the two identical image data being received. However, this causes unnecessary power consumption of the LCD device. Additionally, with the increase in resolution of the LCD device, redundant signal transmission may also result in a severe electromagnetic interference (EMI) problem.

SUMMARY OF THE INVENTION

It is therefore an objective of the present invention to provide a driving method and related device for reducing power consumption of a liquid crystal display (LCD).

According to the present invention, a driving method for reducing power consumption of an LCD is disclosed. The method includes steps of sequentially receiving first data and second data; determining whether the second data is the same as the first data; and controlling a data-line driving circuit not to read in driving data corresponding to the second data when the second data is the same as the first data.

According to the present invention, a driving device for reducing power consumption of an LCD is further disclosed. The driving device includes a data-line driving circuit and a timing controller. The data-line driving circuit is utilized for generating a data-line driving signal to drive the LCD according to driving data and a control signal. The timing controller is coupled to the data-line driving circuit, and is utilized for generating the driving data and the control signal. The timing controller includes a reception terminal, a determination unit and a control signal generation unit. The reception terminal is utilized for sequentially receiving first data and second data. The determination unit is coupled to the reception terminal, and is utilized for determining whether the second data is the same as the first data. The control signal generation unit is coupled to the determination unit, and is utilized for generating and configuring the control signal that controls the data-line driving circuit not to read in driving data corresponding to the second data when the second data is the same as the first data.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
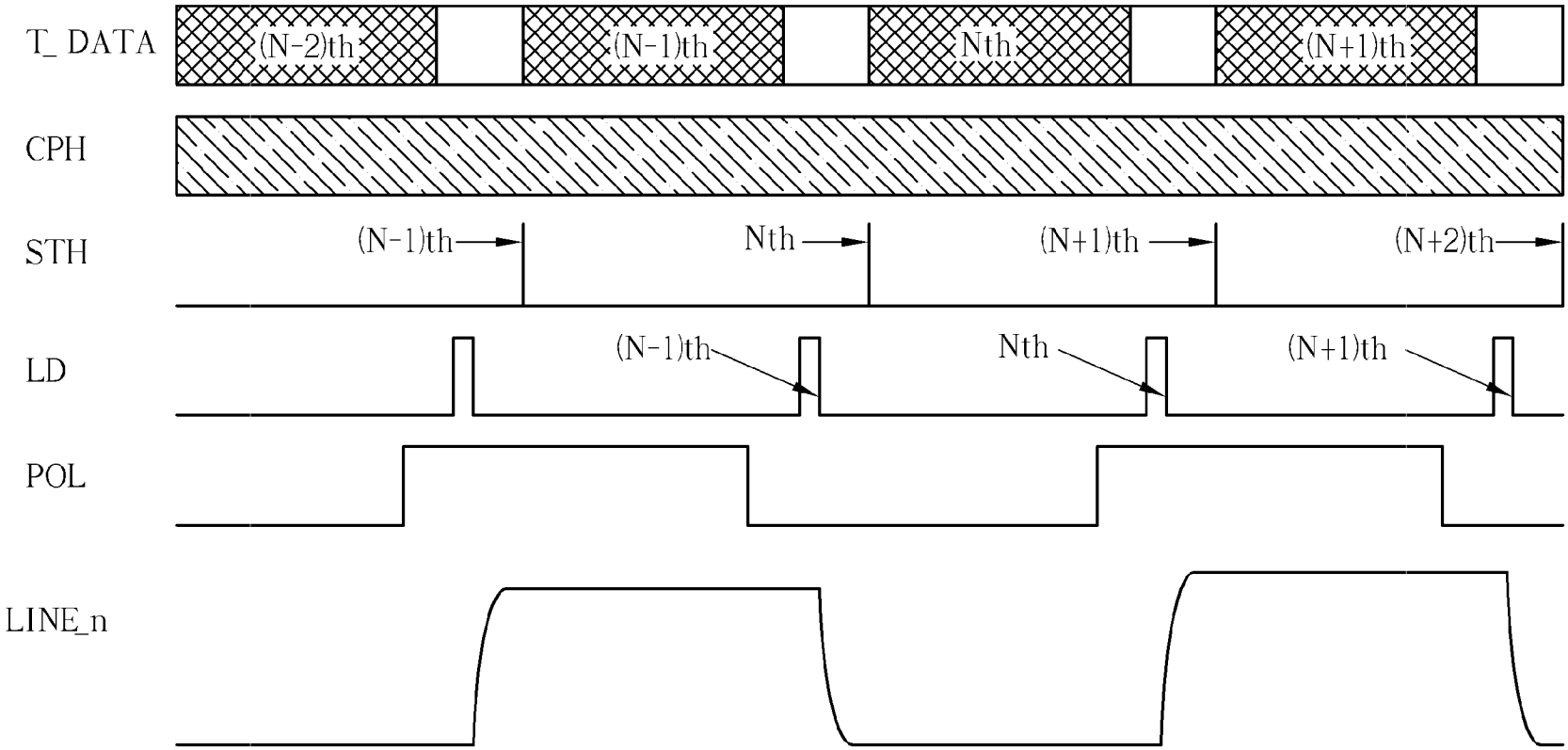
FIG. 1 PRIOR ART
FIG. 1 is a timing diagram of a conventional LCD device.
Figure 2:
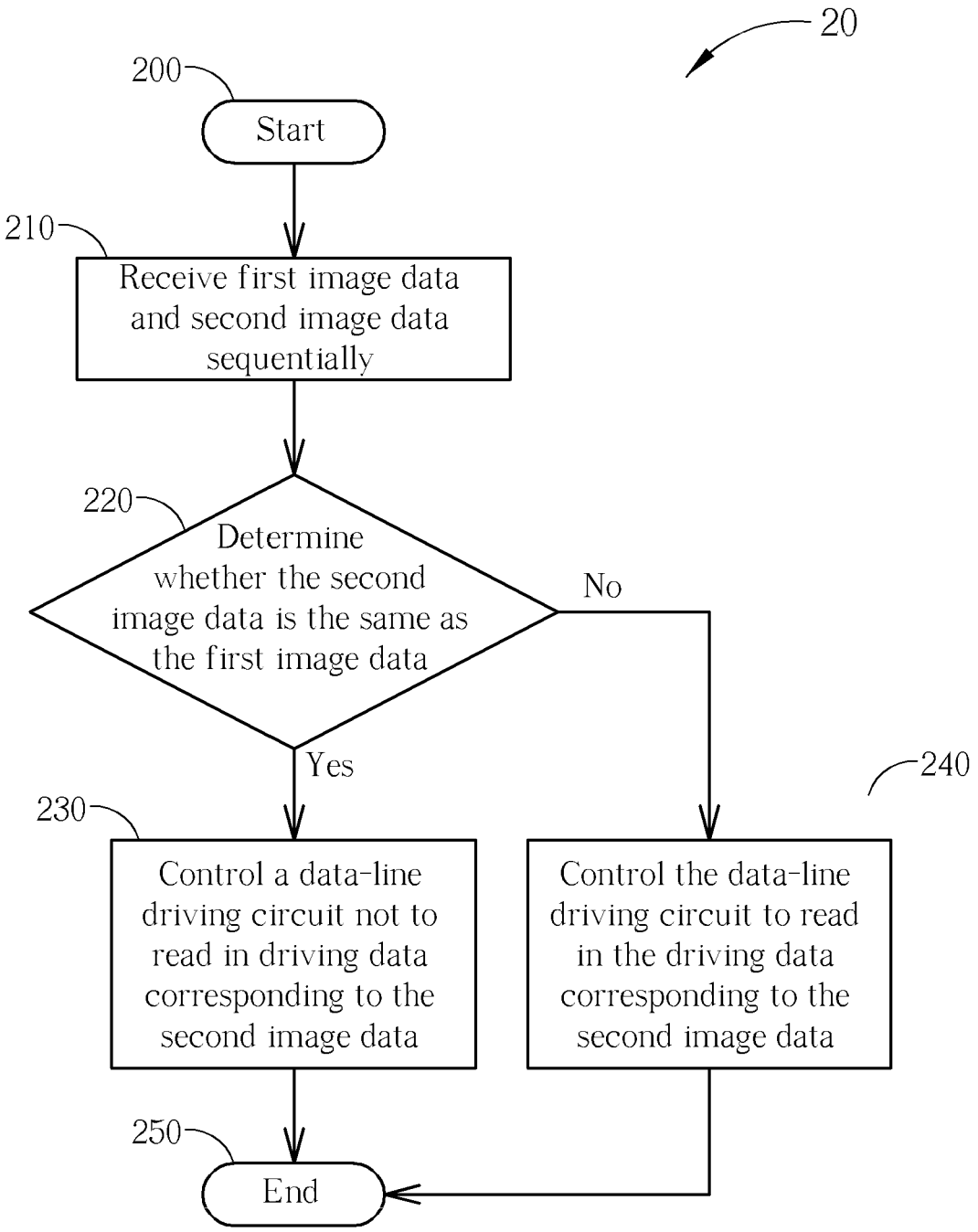
FIG. 2 is a schematic diagram of a driving process for reducing power consumption of an LCD according to the present invention.

Please refer to FIG. 2. FIG. 2 is a schematic diagram of a driving process 20 for reducing power consumption of a liquid crystal display (LCD) according to the present invention. The driving process 20 is applied in a timing controller of the LCD, and includes the following steps:

Step 200: Start.

Step 210: Receive first image data and second image data sequentially.

Step 220: Determine whether the second image data is the same as the first image data. If so, proceed to Step 230; and if not, proceed to Step 240.

Step 230: Control a data-line driving circuit not to read in driving data corresponding to the second image data.

Step 240: Control the data-line driving circuit to read in the driving data corresponding to the second image data.

Step 250: End.

According to the driving process 20, whether the second image data is the same as the first image data is determined after the second image data is received. When the second image data is the same as the first image data, the data-line driving circuit of the LCD is controlled not to read in the driving data corresponding to the second image data. Preferably, the present invention saves generation of a horizontal start signal (STH) to control the data-line driving circuit not to read in the driving data corresponding to the second image data when the second image data is the same as the first image data.

Thus, when two image data successively received by a timing controller are the same, since the horizontal start signal corresponding to the second image data is not generated, the data-line driving circuit cannot read in the driving data corresponding to the second image data, but can directly output a data-line driving signal corresponding to the second image data according to the driving data of the first image data, so as to save power consumption of the LCD.

In addition, when the second image data is the same as the first image data, since the driving data corresponding to the second image data is not received by the data-line driving circuit, the driving data and the clock signal corresponding to the second image data can further be saved in the present invention for reducing data quantity required to be transmitted and generated by the timing controller, so as to improve electromagnetic interference (EMI) of the LCD device significantly.

Certainly, when the second image data is not the same as the first image data, except that the data-line driving circuit is controlled to read in the driving data of the second image data, steps such as generating the driving data, the control signal and the clock signal corresponding to the second image data are also included in the driving process 20 of the present invention. Those are well-known by those skilled in the art, and not narrated herein.

Figure 3:
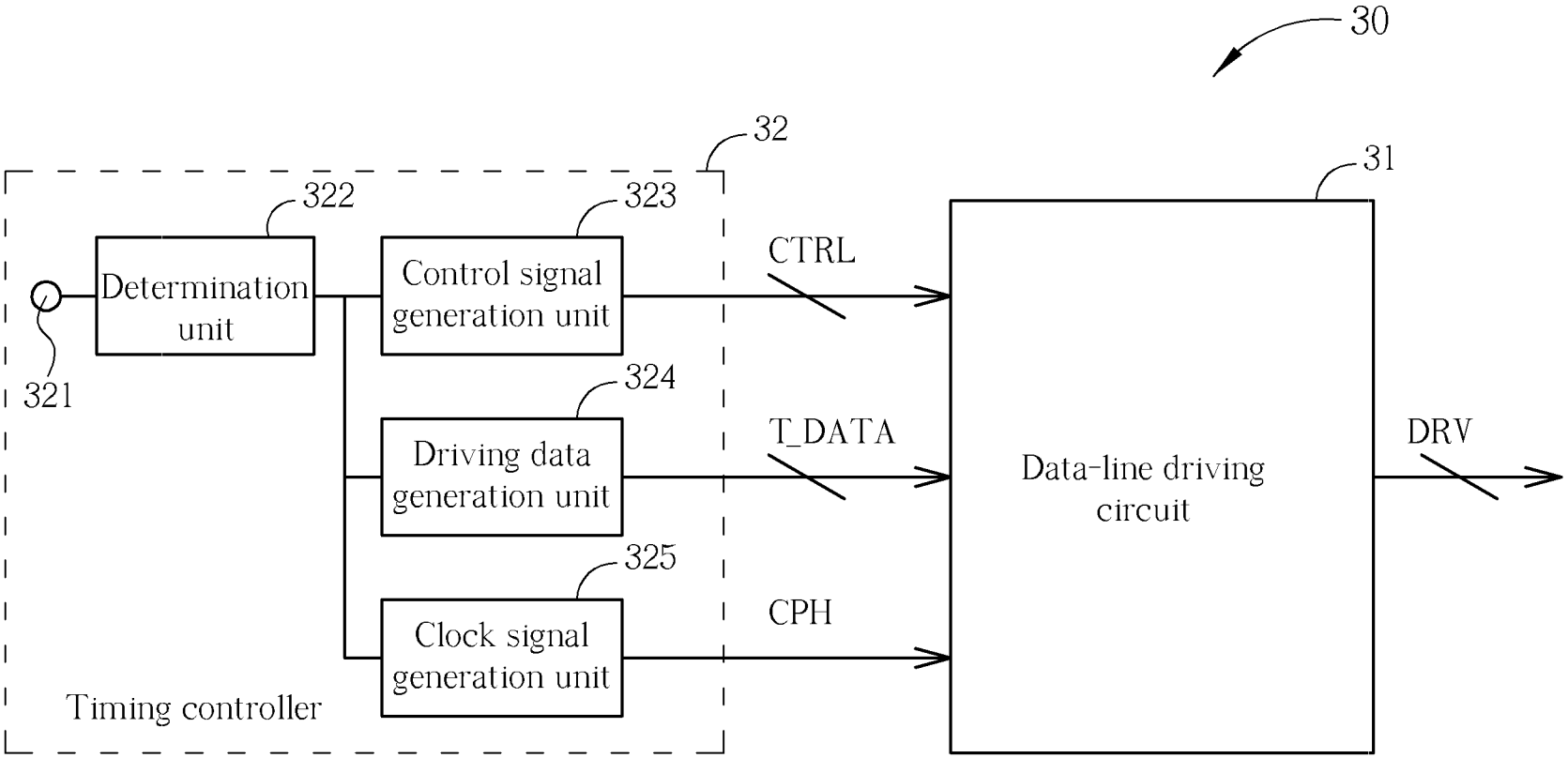
FIG. 3 is a schematic diagram of a driving system for reducing power consumption of an LCD device according to an embodiment of the present invention.

Please further refer to FIG. 3. FIG. 3 is a schematic diagram of a driving system 30 for reducing power consumption of an LCD device according to an embodiment of the present invention. The driving system 30 is utilized for realizing the driving process 20, and includes a data-line driving circuit 31 and a timing controller 32. The data-line driving circuit 31 is utilized for generating a data-line driving signal DRV to drive the LCD device according to a control signal CTRL and driving data T_DATA. The timing controller 32 is coupled to the data-line driving circuit 31, and includes a reception terminal 321, a determination unit 322 and a control signal generation unit 323. The reception terminal 321 is utilized for sequentially receiving first image data and second image data. The determination unit 322 is coupled to the reception terminal 321, and is utilized for determining whether the second image data is the same as the first image data. The control signal generation unit 323 is coupled to the determination unit 322, and is utilized for generating and configuring the control signal CTRL that controls the data-line driving circuit 31 not to read in the driving data corresponding to the second image data when the second image data is the same as the first image data.

Preferably, the control signal CTRL generated by the timing controller 32 is composed of a horizontal start signal (STH), a vertical start signal (STV), a data load signal (LD), a polarity control signal (POL), an output enable signal and so on. When the first image data and the second image data sequentially received by the timing controller 32 are the same, the control signal CTRL generated by the timing controller 32 may exclude the horizontal start signal, i.e. the horizontal start signal is not generated, for controlling the data-line driving circuit 31 not to read in the driving data corresponding to the second image data.

Therefore, when the two image data sequentially received by the timing controller 32 are the same, since the horizontal start signal corresponding to the second image data is not generated, the data-line driving circuit 31 cannot read in the driving data corresponding to the second image data, but can directly output a data-line driving signal corresponding to the second image data according to the driving data of the first image data, so as to save power consumption of the LCD.

In addition, the timing controller 32 further includes a driving data generation unit 324 and a clock signal generation unit 325. The driving data generation unit 324 and the clock signal generation unit 325 are respectively coupled to the determination unit 322, and are utilized for generating the driving data T_DATA and a horizontal clock signal CPH according to the image data received by the reception terminal 321 and a determination result of the determination unit 322.

When the second image data and the first image data are the same, since the driving data of the second image data is not received by the data-line driving circuit 31, the driving data generation unit 324 and the clock signal generation unit 325 can further save generation of the driving data and the clock signal corresponding to the second image data for reducing data quantity required to be generated and transmitted by the timing controller 32, so as to significantly improve the EMI problem of the LCD device.

Please note that the first image data and the second image data mentioned above can be image data corresponding to two adjacent scan-lines on the LCD device, or can be image data of a same source driver of the data-line driving circuit corresponding to two adjacent scan-lines, which are surely not restricted herein.

Figure 4:
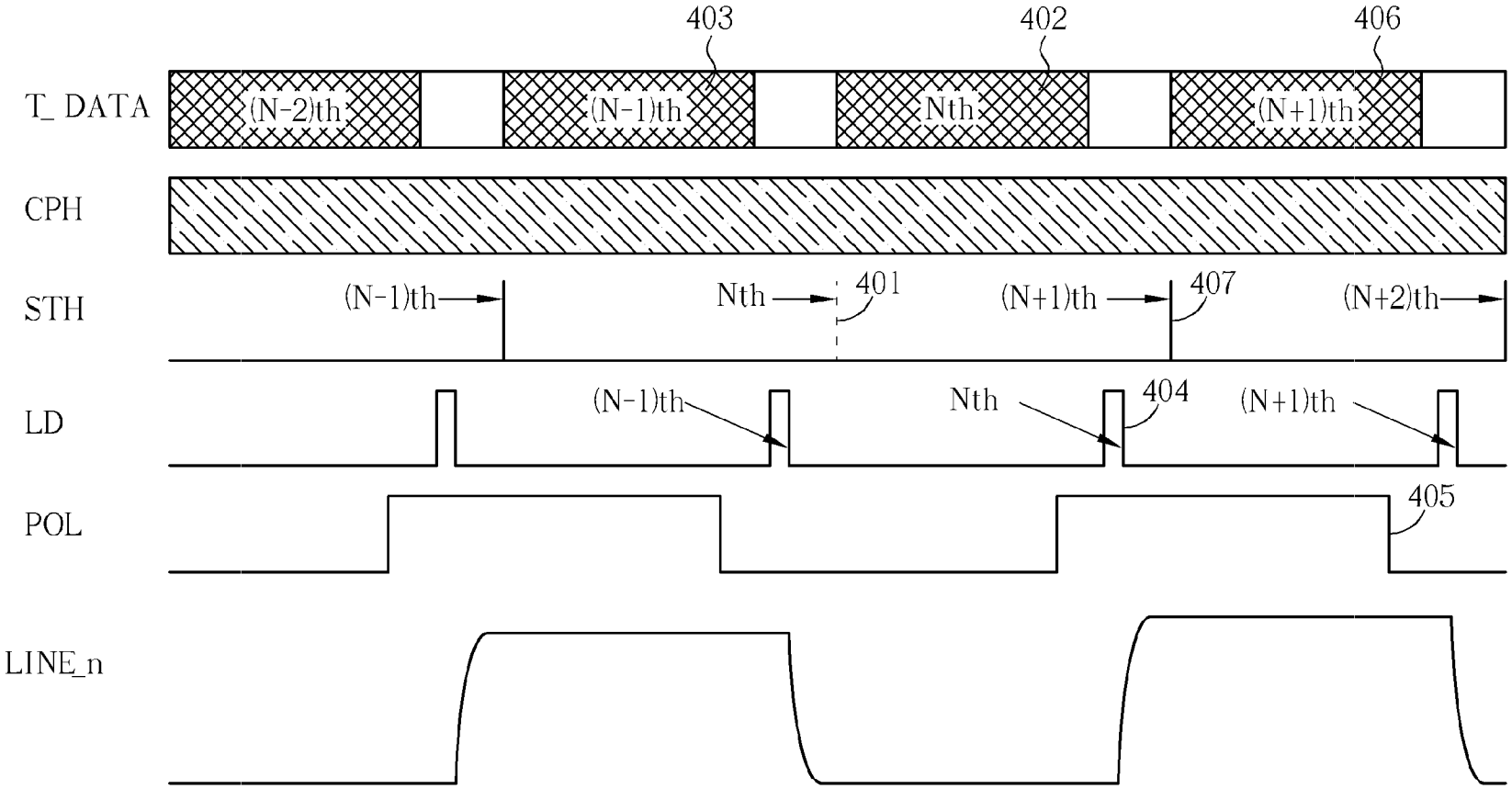
FIG. 4 is a timing diagram of an LCD device according to the present invention.

For example, please refer to FIG. 4. FIG. 4 shows a timing diagram of an LCD device according to the present invention, in which T_DATA stands for driving data outputted by the timing controller 32, CPH stands for a horizontal clock signal, STH stands for a horizontal start signal, LD stands for a data load signal, POL stands for a polarity control signal and LINE_n stands for a data-line driving signal corresponding to a data-line in the LCD device. For the purpose of convenience, the driving data T_DATA is shown by blocks. Each block represents driving data corresponding to a same scan-line, and blank space represents a blanking signal for separating the adjacent driving data. As shown in FIG. 4, when the timing controller 32 determines that the received image data corresponding to the $N^{th}$ and the $(N-1)^{th}$ scan-line are the same, the horizontal start signal STH corresponding to the $N^{th}$ scan-line, i.e. pulse 401, is not generated by the timing controller 32. In this case, the data-line driving circuit 31 cannot be triggered by the horizontal start signal to receive the driving data corresponding to the $N^{th}$ scan-line, i.e. block 402, but can directly output a data-line driving signal corresponding to the $N^{th}$ scan-line according to the driving data (block 403), the data load signal (pulse 404) and the polarity control signal (pulse 405) corresponding to the $(N-1)^{th}$ scan-line, so as to reduce power consumption of the LCD device. Further, the timing controller 32 can stop generating the driving data (block 402) and the clock signal corresponding to the $N^{th}$ scan-line for reducing data quantity needed to be generated and transmitted, so as to significantly reduce the EMI of the LCD device.

On the other hand, when the image data of the $N^{th}$ scan-line are not the same as the image data of the $(N+1)^{th}$ scan-line, the timing controller 32 then generates the driving data (block 406) and the horizontal start signal (pulse 407) according to the image data of the $(N+1)^{th}$ scan-line, so as to control the data-line driving circuit 31 to generate a data-line driving signal corresponding to the $(N+1)^{th}$ scan-line. Conversely, the data-line driving circuit 31 can further be based on the driving data, the data load signal and the polarity control signal of the $(N-1)^{th}$ scan-line to generate the data-line driving signal corresponding to the $(N+1)^{th}$ scan-line.

Figure 5:
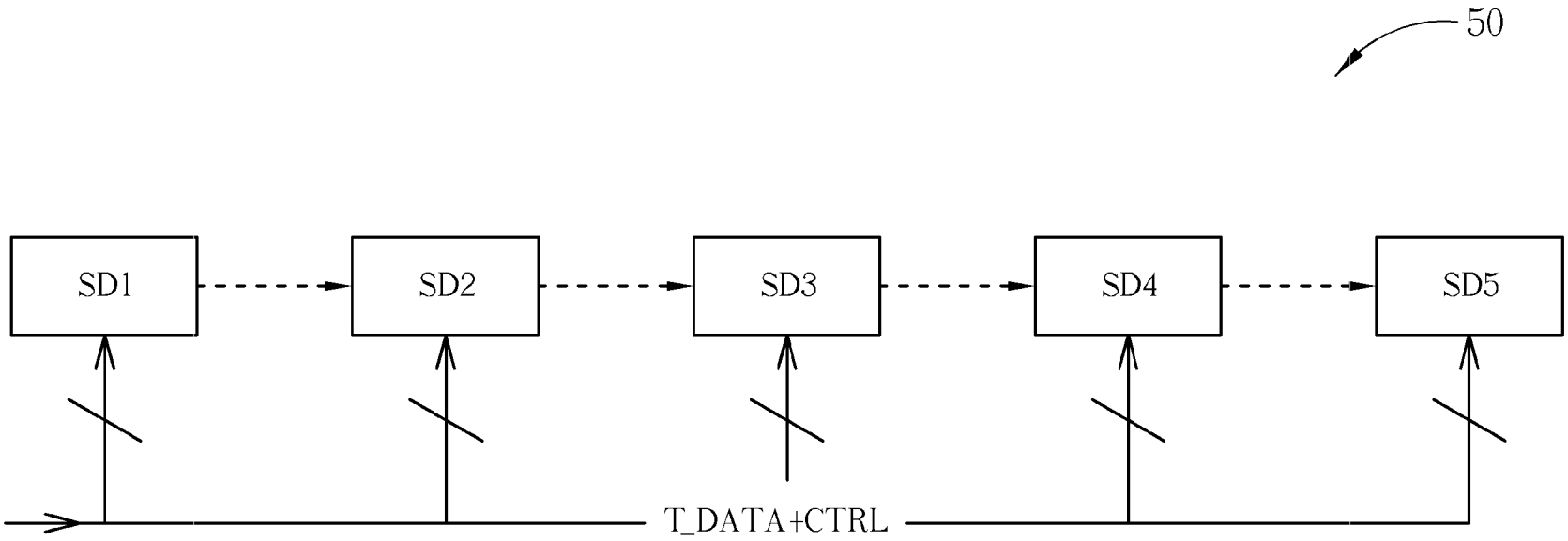
FIG. 5 is a schematic diagram of a data-line driving circuit.

In addition, since the data-line driving circuit is generally composed of multiple source drivers, the present invention can further take the source driver as a basic unit to determine whether to read in the driving data. Please refer to FIG. 5. FIG. 5 is a schematic diagram of a data-line driving circuit 50. The data-line driving circuit 50 includes source drivers SD1~SD5, each of which is utilized for driving a plurality of corresponding data-lines. Preferably, each source driver can be addressed in advance by the data-line driving circuit 50. Thus, the control signal CTRL generated by the timing controller 32, such as the horizontal start signal STH, can be embedded into a blank area of the driving data for transmission, so as to save layout space of circuit wirings.

Figure 6:
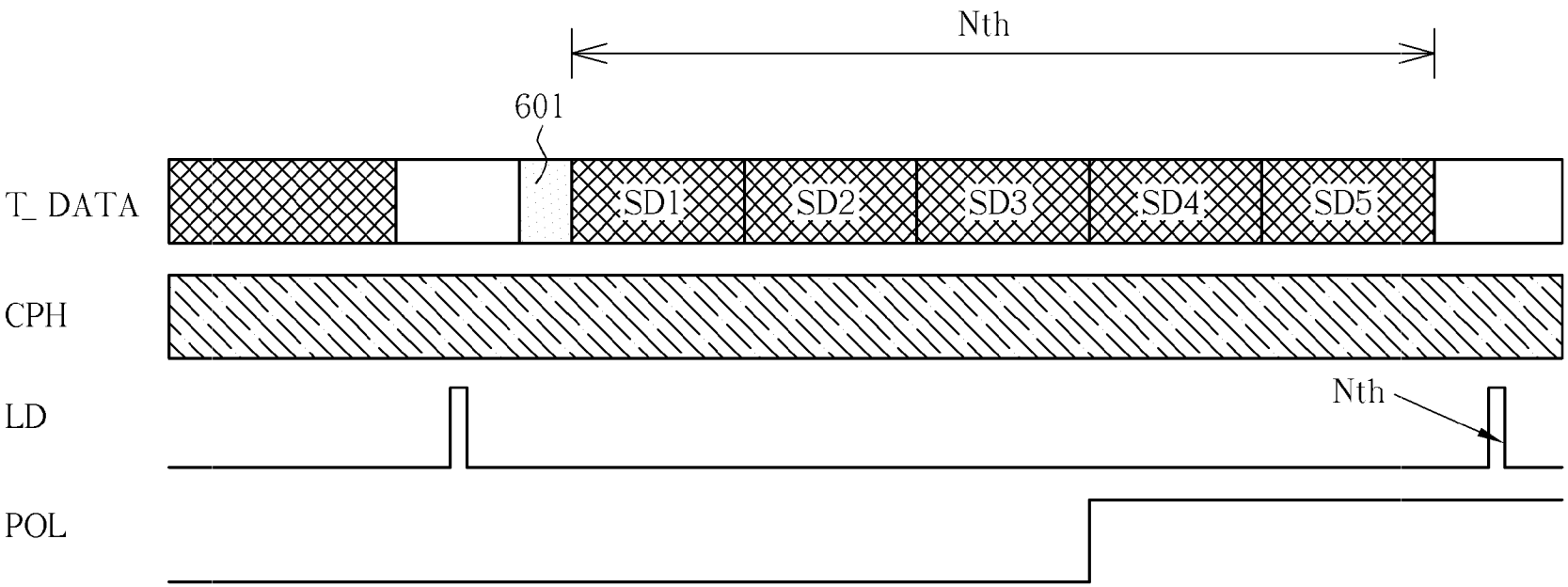
FIG. 6~FIG. 8 are timing diagrams of an LCD device applying the data-line driving circuit of FIG. 5 according to an embodiment of the present invention.
Figure 7:
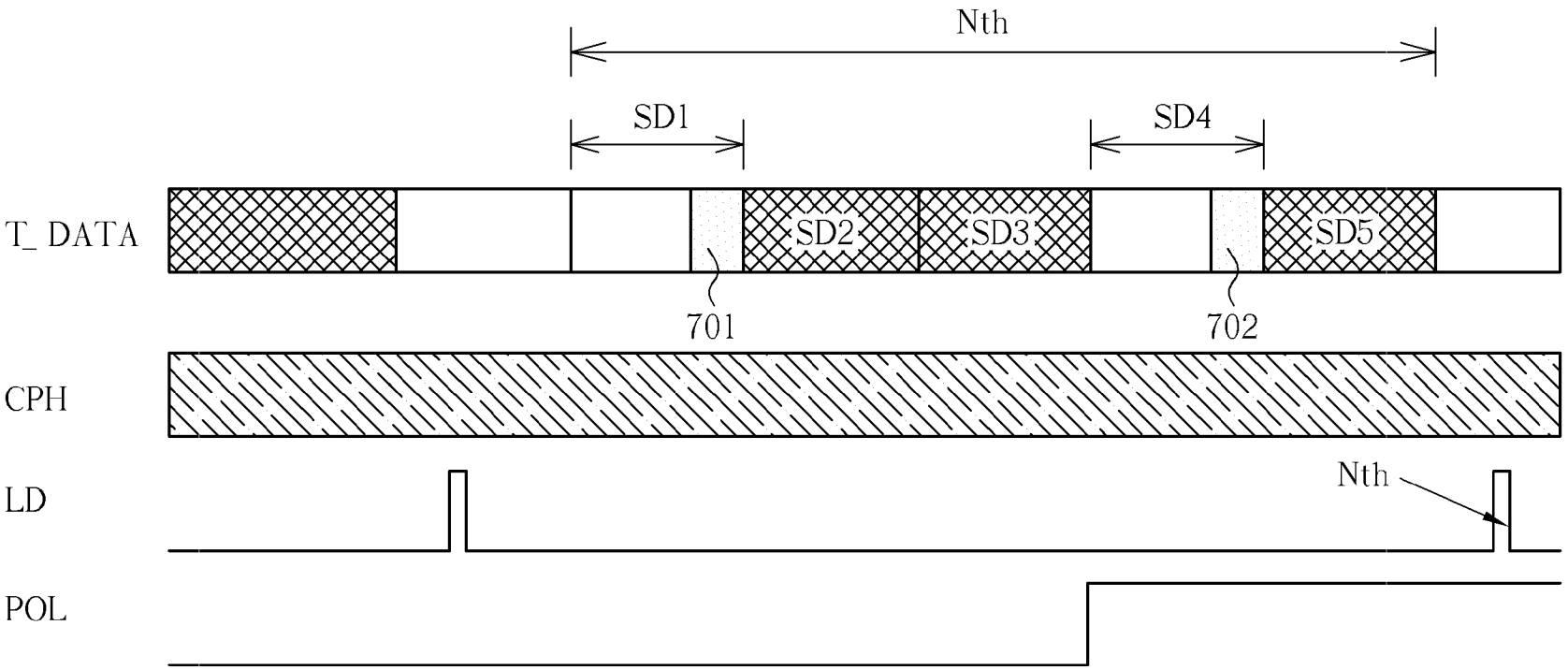
Figure 8:
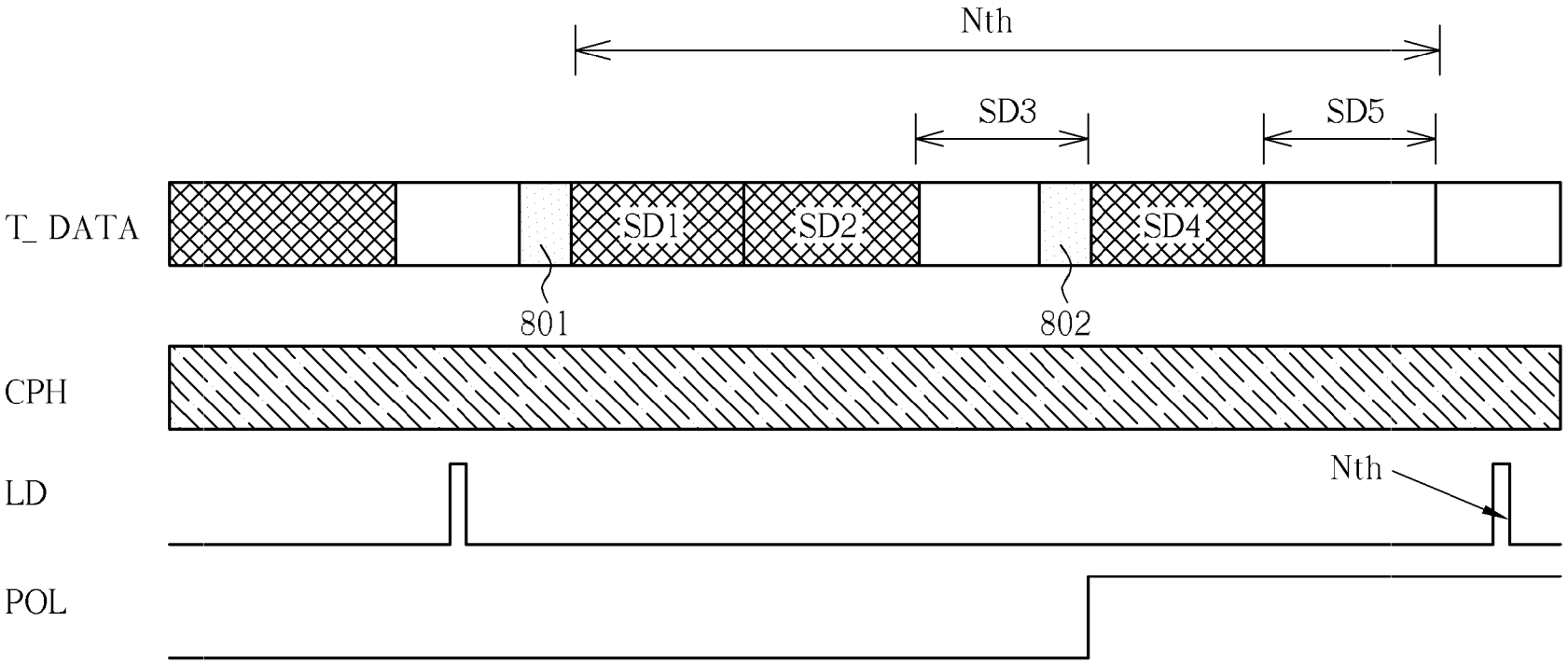
Figure 9:
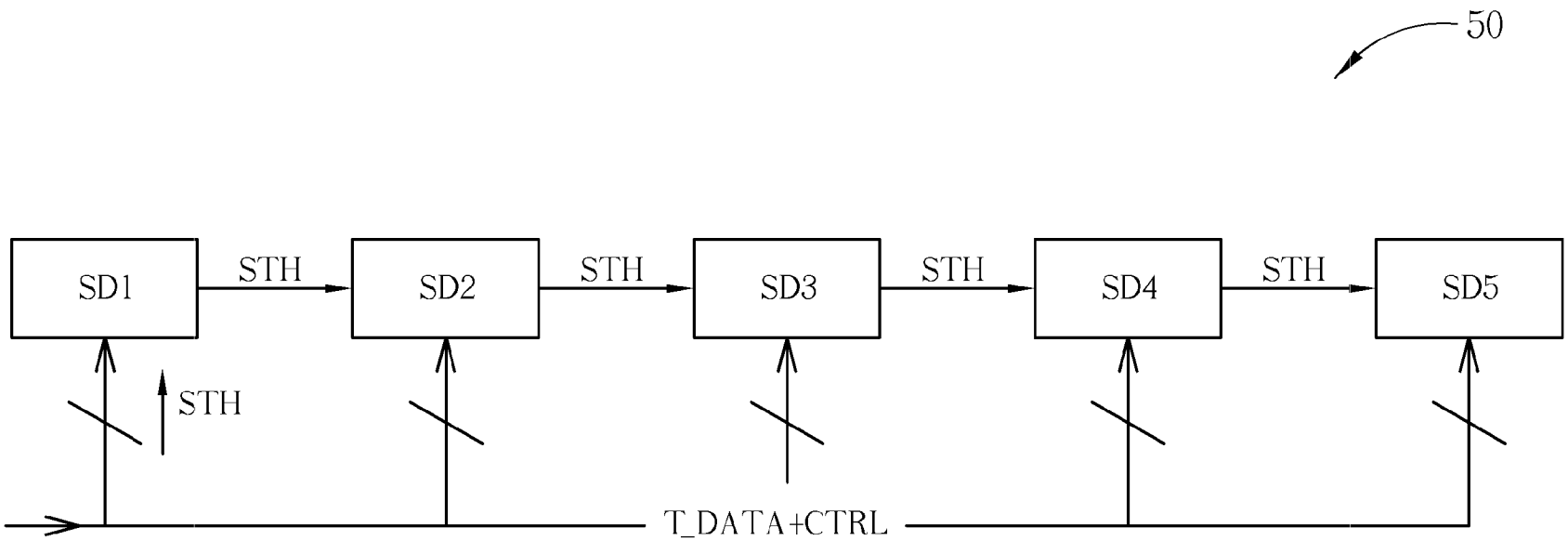
FIG. 9~FIG. 11 shows related operation of the data-line driving circuit of FIG. 5 corresponding to FIG. 6~FIG. 8, respectively.

Please refer to FIG. 6~FIG. 8. FIG. 6~FIG. 8 show timings of an LCD device applying the data-line driving circuit 50 according to an embodiment of the present invention. Compared with FIG. 4, driving data T_DATA simply stands for driving data of the $N^{th}$ scan-line, in which each block represents driving data corresponding to a same source driver, and a horizontal start signal STH is embedded into a blank area of the driving data for transmission. Referring to FIG. 6, in general cases where image data of the source drivers SD1~SD5 in the $N^{th}$ scan-line are all different from those in the $(N-1)^{th}$ scan-line, the timing controller 32 then generates driving data corresponding to the source drivers SD1~SD5 according to the received image data, and embeds a horizontal start signal of the source driver SD1 into a corresponding blanking signal, i.e. block 601, so as to control the data-line driving circuit 50 to read in the driving data corresponding to the source drivers SD1~SD5 successively. Thus, the data-line driving circuit 50 can further generate a corresponding data-line driving signal according to the data load signal LD and the polarity control signal POL. Related operation of the data-line driving circuit 50 is shown in FIG. 9.

Figure 10:
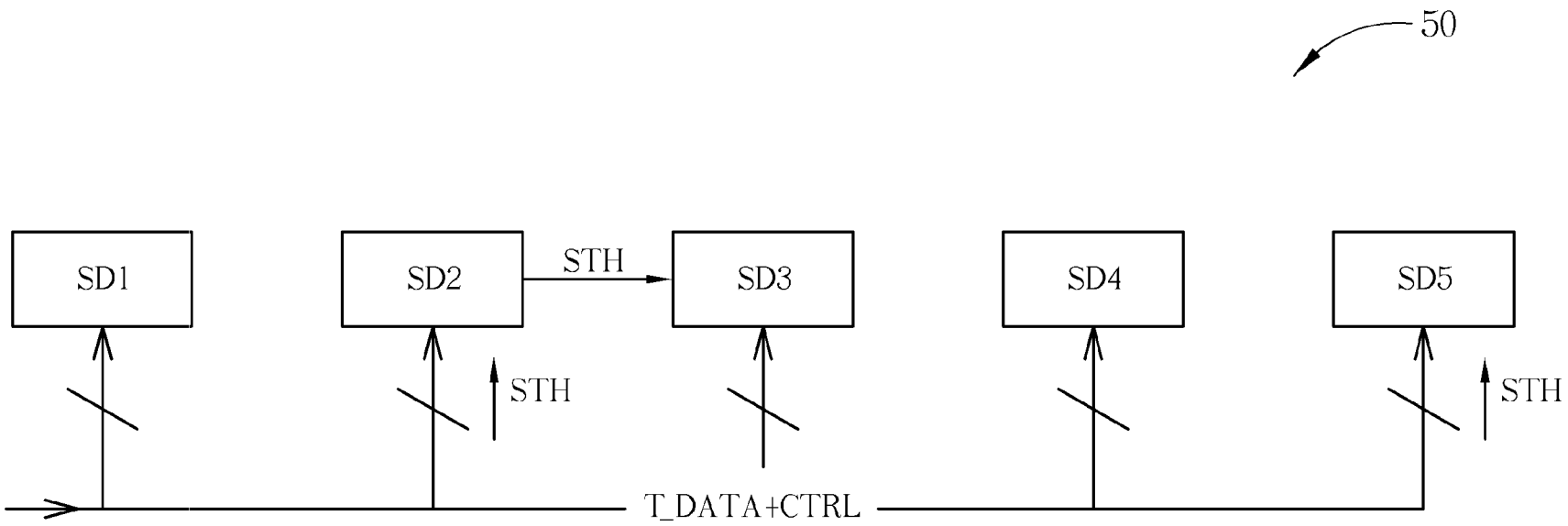

Conversely, if the image data of some source drivers in the $N^{th}$ scan-line are the same as those in the $(N-1)^{th}$ scan-line, the timing controller 32 can take source driver as a basic unit for controlling transmission of the driving data. For example, please refer to FIG. 7. When the timing controller 32 determines that the image data of the source drivers SD1 and SD4 in the $N^{th}$ scan-line are the same as those in the $(N-1)^{th}$ scan-line, there is no need for the timing controller 32 to generate the driving data corresponding to the source drivers SD1 and SD4, so as to save power consumption of the LCD device. In this case, the timing controller 32 can embed a horizontal start signal of the source drivers SD2 and SD3, i.e. block 701, and a horizontal start signal of the source driver SD5, i.e. block 702, into the driving data, respectively, so as to control the data-line driving circuit 50 to successively read in the driving data of the source drivers SD2, SD3 and SD5. Related operation of the data-line driving circuit 50 is shown in FIG. 10.

This is to say, for the source drivers SD1 and SD4, since the driving data of the $N^{th}$ scan-line and the $(N-1)^{th}$ scan-line are the same, the timing controller 32 can save generation of the driving data corresponding to the source drivers SD1 and SD4, so as to save power consumption of the LCD device. However, the data-line driving circuit 50 can still generate data-line driving signals according to the data load signal LD and the polarity control signal POL.

Figure 11:
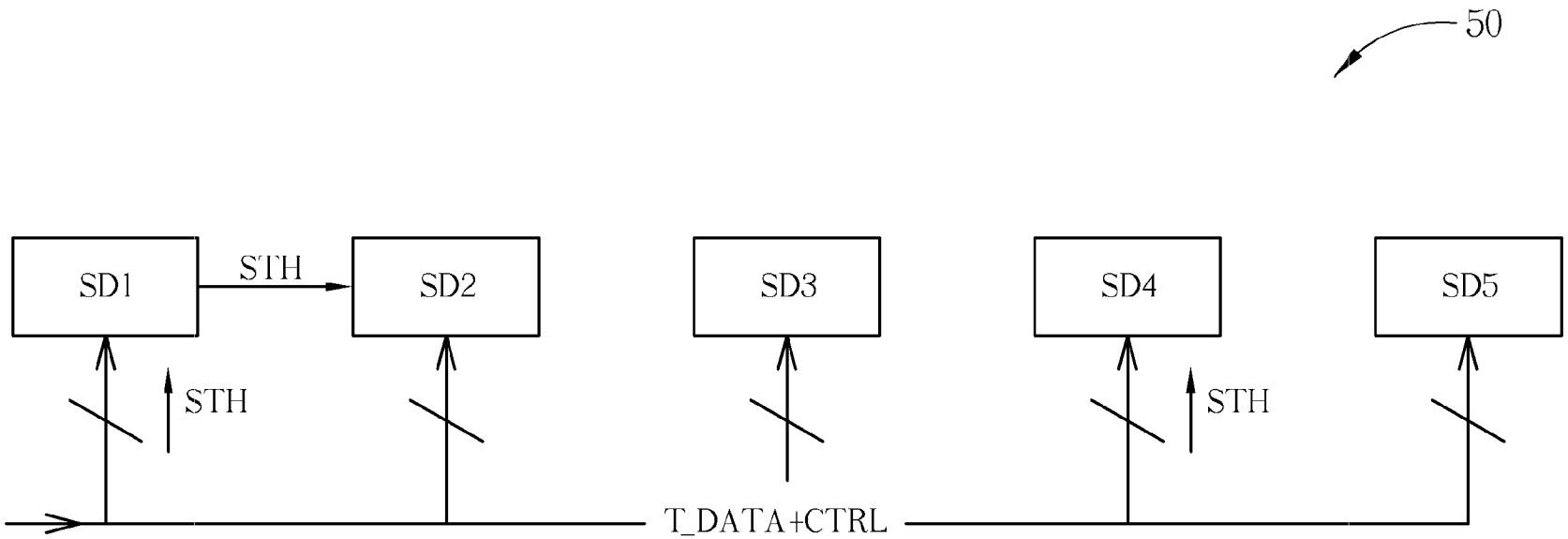

On the other hand, if the image data of the source drivers SD3 and SD5 in the $N^{th}$ scan-line are the same as those in the $(N-1)^{th}$ scan-line, timing of the LCD device is shown in FIG. 8. Similarly, the timing controller 32 needn't generate driving data corresponding to the source drivers SD3 and SD5, and can embed a horizontal start signal of the source drivers SD1 and SD2, i.e. block 801, and a horizontal start signal of the source driver SD4, i.e. block 802, into the driving data, respectively, so as to control the data-line driving circuit 50 to read in the driving data of the source drivers SD1, SD2 and SD4 successively. Related operation of the data-line driving circuit 50 is then shown in FIG. 11.

Namely, in the present invention, the source driver can be considered as a basic unit to determine whether to receive the driving data, or for the timing controller determining whether to stop generating the driving data, so as to save power consumption of the LCD device. Please note that the above embodiments are merely exemplary illustrations of the present invention, those skilled in the art can certainly make appropriate modifications according to practical demands. For instance, the image data of the $N^{th}$ scan-line can be divided into much smaller segments or divided into R, G, B components to compare with those of the $(N-1)^{th}$ scan-line. Such variations also belong to the scope of the present invention.

As mentioned above, the data-line driving circuit of the present invention is controlled not to read in the driving data when the two image data sequentially received by the timing controller are the same, so the power consumption as well as the EMI of the LCD device can be significantly reduced.

Those skilled in the art will readily observe that numerous modifications and alterations of the device and method may be made while retaining the teachings of the invention.

What is claimed is:

1. A driving method for reducing power consumption of a liquid crystal display (LCD), the method comprising:

sequentially receiving first data, third data, second data and fourth data;

determining whether the second data is the same as the first data and whether the third data is the same as the fourth data;

generating a control signal without a first horizontal start signal (STH) and a second horizontal start signal for a data-line driving circuit, when the second data is the same as the first data and the fourth data is the same as the third data;

generating a driving signal without driving data, when the second data is the same as the first data and the fourth data is the same as the third data; and controlling the data-line driving circuit to selectively read in the driving data according to the control signal and the driving signal;

wherein the first data and the second data are image data of a first source driver of the data-line driving circuit corresponding to two adjacent scan-lines, the third data and the fourth data are image data of a second source driver of the data-line driving circuit corresponding to the two adjacent scan-lines, the first horizontal start signal corresponds to the first source driver, and the second horizontal start signal corresponds to the second source driver.

2. The driving method of claim 1, wherein the data-line driving circuit generates a data-line driving signal corresponding to the second data according to driving data corresponding to the first data, when the second data is the same as the first data.

3. The driving method of claim 2, wherein the driving data corresponding to the first data is generated by a timing controller of the LCD.

4. The driving method of claim 1 further comprising:

saving generation of a clock signal corresponding to the second data when the second data is the same as the first data.

5. A driving device for reducing power consumption of a liquid crystal display (LCD), the driving device comprising:

a data-line driving circuit, for generating a data-line driving signal to drive the LCD according to driving data and a control signal; and a timing controller, coupled to the data-line driving circuit, for generating the driving data and the control signal, the timing controller comprising:

a reception terminal, for sequentially receiving first data, third data, second data and fourth data;

a determination unit, coupled to the reception terminal, for determining whether the second data is the same as the first data, and determining whether the fourth data is the same as the third data;

a driving data generation unit, coupled to the determination unit, for generating driving data individually corresponding to the first data, the third data, the second data and the fourth data, and saving generation of the driving data corresponding to the second data when the second data is the same as the first data and saving generation of the driving data corresponding to the fourth data when the fourth data is the same as the third data; and a control signal generation unit, coupled to the determination unit, for generating and configuring the control signal to selectively include a first horizontal start signal (STH) and a second horizontal start signal;

wherein the data-line driving circuit is controlled not to read in the driving data corresponding to the second data when the second data is the same as the first data, and is controlled not to read in the driving data corresponding to the fourth data when the fourth data is the same as the third data;

wherein the first data and the second data are image data of a first source driver of the data-line driving circuit corresponding to two adjacent scan-lines, the third data and the fourth data are image data of a second source driver of the data-line driving circuit corresponding to the two adjacent scan-lines, the first horizontal start signal corresponds to the first source driver, and the second horizontal start signal corresponds to the second source driver.

6. The driving device of claim 5, wherein the data-line driving circuit generates a data-line driving signal corresponding to the second data according to driving data corresponding to the first data, when the second data is the same as the first data.

7. The driving device of claim 6, wherein the driving data corresponding to the first data is generated by the timing controller, and is registered into the data-line driving circuit.

8. The driving device of claim 5, wherein the control signal generation unit generates the control signal to control the data-line driving circuit to read in the driving data corresponding to the second data when the second data is not the same as the first data.

9. The driving device of claim 5, wherein the timing controller further comprises:

a clock signal generation unit, coupled to the determination unit, for generating clock signals individually corresponding to the first data and the second data.

10. The driving device of claim 9, wherein the clock signal generation unit saves generation of the clock signal corresponding to the second data when the second data is the same as the first data.

11. A driving method for reducing power consumption of a liquid crystal display (LCD), the method comprising:

sequentially receiving first data and second data, wherein each of the first data and the second data comprises respective data of a plurality of source drivers;

comparing corresponding data for a same source driver between the first data and the second data for each of the source drivers, so as to determine whether the respective data of at least one of the source drivers in the second data is the same as the respective data of the at least one of the source drivers in the first data;

generating a control signal without a horizontal start signal (STH) and a driving signal without driving data for the at least one source driver, when the second data is the same as the first data; and controlling the at least one source driver to selectively read in the driving data according to the control signal and the driving signal.

12. The driving method of claim 11, wherein the first data and the second data are image data corresponding to two adjacent scan-lines on the LCD.

13. The driving method of claim 11, further comprising generating a data-line driving signal corresponding to the respective data of the at least one source driver in the second data according to the driving data corresponding to the respective data of the at least one source driver in the first data when the respective data of the at least one source driver in the second data is the same as the respective data of the at least one source driver in the first data.

14. The driving method of claim 13, wherein the driving data corresponding the first data is generated by a timing controller of the LCD.

15. The driving method of claim 11, further comprising:

saving generation of at least one clock signal corresponding to the respective data of the at least one source driver in the second data when the data of the at least one source driver in the second data is the same as the respective data of the at least one source driver in the first data.

16. The driving method of claim 11, when a horizontal start signal (STH) for any one of the source drivers is generated, the STH is embedded in the driving data of the source driver.

17. A driving device for reducing power consumption of a liquid crystal display (LCD), the driving device comprising:

a data-line driving circuit, comprising a plurality of source drivers, for generating a data-line driving signal to drive the LCD according to driving data and a control signal; and a timing controller, coupled to the source drivers, for generating the driving data and the control signal, the timing controller comprising:

a reception terminal, for sequentially receiving first data and second data, wherein each of the first data and the second data comprises respective data of the plurality of source drivers;

a determination unit, coupled to the reception terminal, for comparing corresponding data for a same source driver between the first data and the second data for each of the source drivers, so as to determine whether the respective data of at least one of the source drivers in the second data is the same as the respective data of the at least one of the source drivers in the first data; and a control signal generation unit, coupled to the determination unit, for generating a control signal without a horizontal start signal (STH) and a driving signal without driving data for the at least one source driver when the second data is the same as the first data, to control the at least one source driver to selectively read in the driving data according to the control signal and the driving signal.

18. The driving device of claim 17, wherein the first data and the second data are image data corresponding to two adjacent scan-lines on the LCD.

19. The driving device of claim 17, wherein the data-line driving circuit generates the data-line driving signal corresponding to the respective data of the at least one source driver in the second data according to driving data corresponding to the respective data of the at least one of the source drivers in the first data when the respective data of the at least one source driver in the second data is the same as the respective data of the at least one source driver in the first data.

20. The driving device of claim 19, wherein the driving data corresponding to the first data is generated by the timing controller, and is registered into the data-line driving circuit.

21. The driving device of claim 17, wherein the control signal generation unit further generates the control signal to control the data-line driving circuit to read in the driving data corresponding to the respective data of at least one of the source drivers in the second data when the respective data of the at least one of the source drivers in the second data is not the same as the respective data of the at least one of the source drivers in the first data.

22. The driving device of claim 17, wherein the timing controller further comprises:

a driving data generation unit, coupled to the determination unit, for generating driving data individually corresponding to the respective data of the source drivers in the first data and the second data.

23. The driving device of claim 22, wherein the driving data generation unit saves generation of the driving data corresponding to the respective data of the at least one of the source drivers in the second data when the respective data of the at least one of the source drivers in the second data is the same as the respective data of the at least one of the source drivers in the first data.

24. The driving device of claim 17, wherein the timing controller further comprises:

a clock signal generation unit, coupled to the determination unit, for generating clock signals individually corresponding to the respective data of the source drivers in the first data and the second data.

25. The driving device of claim 24, wherein the clock signal generation unit saves generation of at least one of the clock signals corresponding to the respective data of the at least one of the source drivers in the second data when the respective data of the at least one of the source drivers in the second data is the same as the respective data of the at least one of the source drivers in the first data.

26. The driving method of claim 17, when the control signal generation circuit generates a horizontal start signal (STH) for any one of the source drivers, the STH is embedded in the driving data of the source driver.

* * * * *